US007600401B2

(12) United States Patent
Rosenzweig

(10) Patent No.: US 7,600,401 B2
(45) Date of Patent: Oct. 13, 2009

(54) FABRIC STEAM POCKET AND ATTACHMENT FOR USE WITH STEAM CLEANER

(75) Inventor: Maximilian Rosenzweig, Cote St. Luc (CA)

(73) Assignee: Euro-Pro Operating,LLC, West Newton, MA (US)

( * ) Notice: Subject to any disclaimer, the term of this patent is extended or adjusted under 35 U.S.C. 154(b) by 490 days.

(21) Appl. No.: 10/884,192

(22) Filed: Jul. 2, 2004

(65) Prior Publication Data

US 2006/0000241 A1 Jan. 5, 2006

(51) Int. Cl.
*A47L 13/00* (2006.01)
*A47L 13/20* (2006.01)
*A47L 13/25* (2006.01)

(52) U.S. Cl. ..... 68/5 R; 15/228; 15/229.1

(58) Field of Classification Search ..... 15/322, 15/403, 228, 229.3; 68/5 R, 222
See application file for complete search history.

(56) References Cited

U.S. PATENT DOCUMENTS

| | | | | |
|---|---|---|---|---|
| 1,720,165 | A | 7/1929 | Bloom | |
| 2,053,282 | A | 9/1936 | Gewalt | |
| 2,831,207 | A * | 4/1958 | Thompson et al. | 15/228 |
| 4,073,030 | A | 2/1978 | Albishausen | |
| 4,074,387 | A | 2/1978 | Arato et al. | |
| 4,114,223 | A * | 9/1978 | Buchanan | 15/228 |
| 4,327,459 | A | 5/1982 | Gilbert | |
| 4,584,736 | A | 4/1986 | Gremminger | |
| 4,905,712 | A * | 3/1990 | Bowlin et al. | 5/637 |
| 5,165,866 | A | 11/1992 | Kato | |
| 6,289,551 | B1 | 9/2001 | Basile | |
| 6,490,753 | B1 | 12/2002 | Chen | |
| 6,571,421 | B1 | 6/2003 | Sham et al. | |
| 7,380,307 | B2 | 6/2008 | Tsai | |
| 2002/0094285 | A1 | 7/2002 | Paolini et al. | |
| 2002/0106970 | A1 * | 8/2002 | Falla | 450/1 |
| 2002/0112744 | A1 | 8/2002 | Besseling | |
| 2003/0089383 | A1 | 5/2003 | Biggs | |
| 2004/0134016 | A1 | 7/2004 | Kisela | |
| 2006/0000049 | A1 | 1/2006 | Rosenzweig | |

(Continued)

FOREIGN PATENT DOCUMENTS

CH 429 211 A 1/1967

(Continued)

OTHER PUBLICATIONS

FR 2282252 A: Rene Plouvier, Wringer Mop, Mar. 1976 English Translation By: The McElroy Translation Company—Jul. 2007.*

(Continued)

*Primary Examiner*—Frankie L Stinson
*Assistant Examiner*—Samuel A Waldbaum
(74) *Attorney, Agent, or Firm*—McCarter & English LLP; Michael I. Wolfson

(57) ABSTRACT

A fabric steam pocket attachment for a steam cleaner having a replaceable fabric pocket that fits snugly over a flat frame having an interior steam nozzle is provided. The frame includes two arms extending outwardly from a base with inwardly projecting fingers to form a rectangular shape. The arms are biased outwardly and may be pressed towards each other to allow for easy placement of the steam pocket on the frame.

16 Claims, 4 Drawing Sheets

U.S. PATENT DOCUMENTS

2007/0130719 A1 6/2007 Zhou

FOREIGN PATENT DOCUMENTS

| | | | | |
|---|---|---|---|---|
| CN | 1368032 | A | | 9/2002 |
| CN | 2540155 | Y | | 3/2003 |
| CN | 2568117 | Y | | 8/2003 |
| DE | 24 31 102 | A1 | | 1/1976 |
| DE | 298 22 052 | U1 | | 3/1976 |
| DE | 91 10 171 | U1 | | 3/1993 |
| DE | 299 10 658 | U1 | | 9/1999 |
| DE | 200 01 462 | U1 | | 1/2001 |
| DE | 20001462 | U1 | * | 1/2001 |
| DE | 100 15 941 | A1 | | 10/2001 |
| DE | 102 05 507 | A1 | | 8/2003 |
| DE | 20 2006 001189 | U1 | | 4/2006 |
| EP | 1 027 855 | A2 | | 8/2000 |
| EP | 1 224 899 | A | | 7/2002 |
| EP | 1 224 899 | A2 | | 7/2002 |
| EP | 1 554 968 | A | | 7/2005 |
| FR | 601 312 | A | | 2/1926 |
| FR | 2282252 | A | * | 3/1976 |
| FR | 2282252 | A | * | 4/1976 |
| GB | 1 449 483 | | | 8/1973 |
| GB | 2 294 196 | A | | 4/1996 |
| GB | 2294196 | A | * | 4/1996 |
| GB | 2 416 526 | A | | 2/2006 |
| JP | 2001 327449 | A | | 11/2001 |
| JP | 2004337454 | A | | 12/2004 |
| WO | WO 98/23385 | A | | 6/1998 |
| WO | WO 99/26522 | A | | 6/1999 |
| WO | WO 02/43550 | A | | 6/2002 |
| WO | WO 02/43550 | A1 | | 6/2002 |
| WO | WO 2007/065371 | A | | 6/2007 |

OTHER PUBLICATIONS

STIC Translation of Vogt (DE 200 01 462 U 1).*

STIC Translation of Plouvier (FR 2 282 252). The translation was provided in the First Action On the Merits—Non-Final Rejection, dated Jul. 11, 2007.*

FR 2 282 252 A: Rene Plouvier, Wringer Mop, Mar. 1976 English Translation By: The McElroy Translation Company—Jul. 2007.*

STIC Translation of Vogt (DE 200 01 462 U 1), Mar. 1, 2001.*

Euro-Pro Operating LLC; Portable Shark Steam Cleaner Owner's Manual Model SC505; Jan. 2003; p. 7; Champlain, NY 12919.

Patent Abstracts of Japan, vol. 2002, No. 03, Apr. 3, 2002, Publication No. 2001327449 (Alpha Homes: KK), Nov. 21, 2001.

Euro-Pro Operating LLC; Steam Shark II Owner's Manual Model EP908EF; Nov. 2003; St. Laurent, Quebec H4S 1A7, pp. 1-39.

* cited by examiner

FABRIC STEAM POCKET AND ATTACHMENT FOR USE WITH STEAM CLEANER

BACKGROUND OF THE INVENTION

The invention relates generally to a fabric steam pocket, and more particularly to a fabric steam pocket attachment for use with a steam cleaner.

Steaming devices used to apply steam to household objects are well known. The uses of the devices vary widely, and may include the application of steam to drapes or other fabrics to ease wrinkles, and the application of steam to objects to assist in cleaning the objects.

Typical steam devices have a reservoir for storing water with a heating element to heat the water. The heated water generates steam, which may be directed towards its intended destination through a nozzle which controls the application of the steam. Variation of the shape and size of the nozzle allows for preferred distribution of generated steam to an object to be cleaned. The nozzles may be disconnectable from the steam generator to allow different nozzles to be utilized, based on the object to be steamed. The nozzle may be either closely coupled to the steam generator, or located at a distance from the steam generator, requiring tubing or other steam transfer structures to be interconnected between the steam generator and the discharge nozzle. Typically, it is beneficial to provide suitable connectors between the steam generator and the nozzle to allow either the nozzle to be connected to the steam generator, or to allow the interpositioning of transfer tubes or hoses between the steam generator and the nozzle.

In general, the nozzles used with the steam cleaners do not have large surface areas and a cloth to absorb the liquid condensate of the steam. In order to increase the cleaning surface area, a flat fabric piece is folded around a flat brush or nozzle. The folded fabric on top of the brush or nozzle is secured by a clip on top of the piece. Often steam injected behind the cloth passes through the cloth at the points the bristles contact on the cloth. This tends to wet the cloth and reduce the cleaning effectiveness of the steam. In addition, the cloth covers must be carefully attached not to cover the front or back of the brush attachment.

Notwithstanding the wide variety of steam generating appliances available, there exists the need to provide an easy to install attachment for use with a steam cleaner. That will effectively improve the effective steaming surface area of the steam cleaners. It is desirable to provide this device with the ability for a user to clean a larger surface area easily without worrying about wiping up the liquid condensate of the steam when cleaning flooring, furniture and other household items.

SUMMARY OF THE INVENTION

Generally speaking, in accordance with the invention, a fabric steam pocket attachment suitable for cleaning large surface areas for use with steam cleaner is provided. A steam generating device includes a water reservoir with a heating element for generating steam that is transferred through a hose to a hand grip with a valve for regulating the amount of steam fed to a rigid pipe or nozzle. The fabric steam pocket attachment includes a back frame or base pivotally connected to the steamer pipe. A pair of opposed side arms extended outwardly from the base on opposed end with inwardly projecting fingers facing each other, but not meeting. The arms are mounted at right angles to the base and may be flexed inwardly to install the fabric steam pocket over the extending arms. The pocket is two layers of fabric joined at three edges with fasteners at the open edge for fastening the pocket over the base of the frame.

A steam nozzle is mounted to the base of the attachment and is operatively connected to the steam cleaner outlet pipe. When steam is injected into the pocket, the entire surface area of the fabric may be used to steam clean a surface.

Accordingly, it is an object of the invention to provide a fabric steam pocket attachment to provide increased steam cleaning surface area.

Another object of the invention is to provide a fabric steam pocket that is easily mounted on an attachment for a steam cleaner.

A further object of the invention is to provide a steam cleaning attachment with a fabric cover that does not allow steam to escape at points of contact with brush bristles.

Yet another object of the invention is a fabric steam pocket that can be used for dual side cleaning.

Still other objects and advantages of the invention will in part be obvious and will in part be apparent from the specification.

The invention accordingly comprises a product possessing the features, properties, and the relation of components which will be exemplified in the product hereinafter described, and the scope of the invention will be indicated in the claims.

BRIEF DESCRIPTION OF THE DRAWINGS

For a fuller understanding of the invention, reference is made to the following description taken in connection with the accompanying drawing(s), in which.

DETAILED DESCRIPTION OF THE INVENTION

Figure 1:
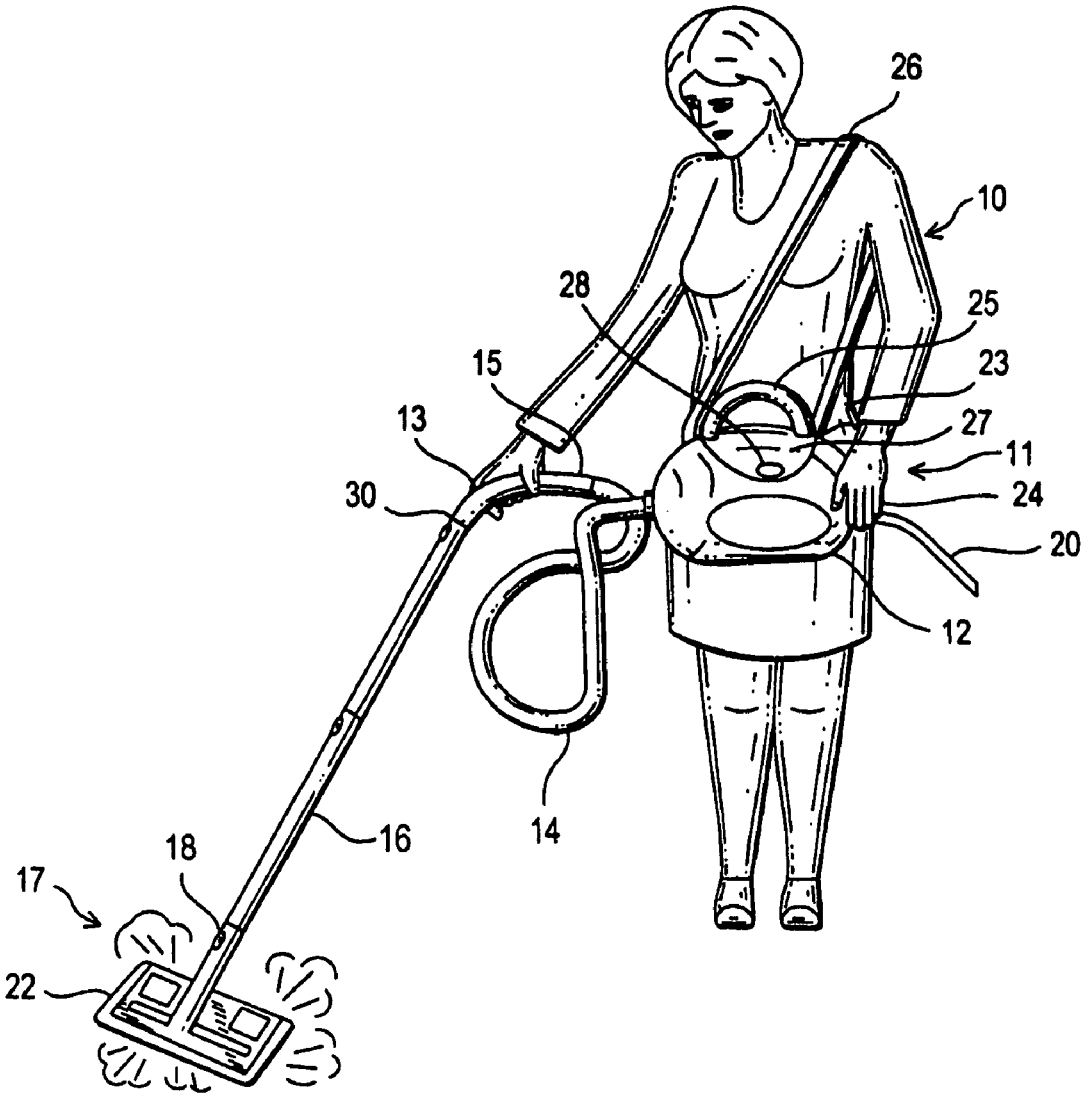
FIG. 1 is a perspective view of a user cleaning a floor with a portable steam cleaning device including a fabric steam pocket attachment constructed and arranged in accordance with the invention.

FIG. 1 is a perspective view of a user 10 using a steam cleaning device 11 including a main body 12 and a steam release hand grip 13 coupled to main body 12 by a flexible hose 14 and a steam outlet 15. A rigid pipe 16 is mounted on the distal nozzle end of hand grip 13. A fabric steam pocket attachment 17 constructed and arranged in accordance with the invention is mounted on the distal end of the rigid pipe 16. Fabric steam pocket attachment 17 is rectangular in shape and includes a pivotable hole steam inlet coupling 18 at the back edge or proximal end. A steam outlet 19 shown in FIG. 2*a* dispenses a steam into a steam pocket fabric 22 which covers a steam pocket frame 31 on the front or distal side of fabric steam pocket attachment 17.

Steam inlet 18 has the same configuration as outlet 15 to rigid pipe 16. This allows for installation of the different attachments to steam release hand grip 13 of steam cleaner 11, such as brushes and nozzles.

Main body 12 of steam cleaning device 11 includes a water inlet 23 and an internal water reservoir with heating elements connected to a power source by a power cord 20. Steam generated in reservoir 24 exits by steam outlet 15 through flexible hose 14 coupled thereto. Main body 12 is outfitted with a handle 25 and a strap 26 to allow user t10 to lift and carry main body 12. Conveniently, main body 12 also includes an on/off switch 27 and an indicator light 28 to indicate when steam temperature is appropriate for use.

Once water has been heated sufficiently to generate steam within main body 12, user 10 may selectively release steam by operation of hand grip 13. Hand grip 13 has a distal outlet end 30 for securing rigid pipe, or additional attachments, such as brushes or nozzles.

Figure 2A:
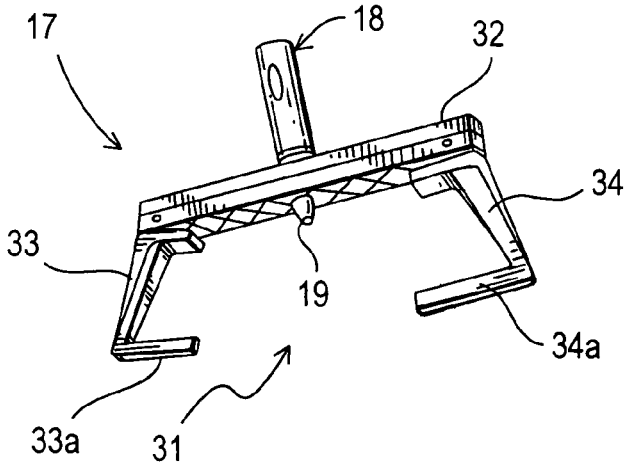
FIG. 2*a* is a perspective view of the fabric steam pocket attachment for use with a steam cleaner of the type shown in FIG. 1.
Figure 4:
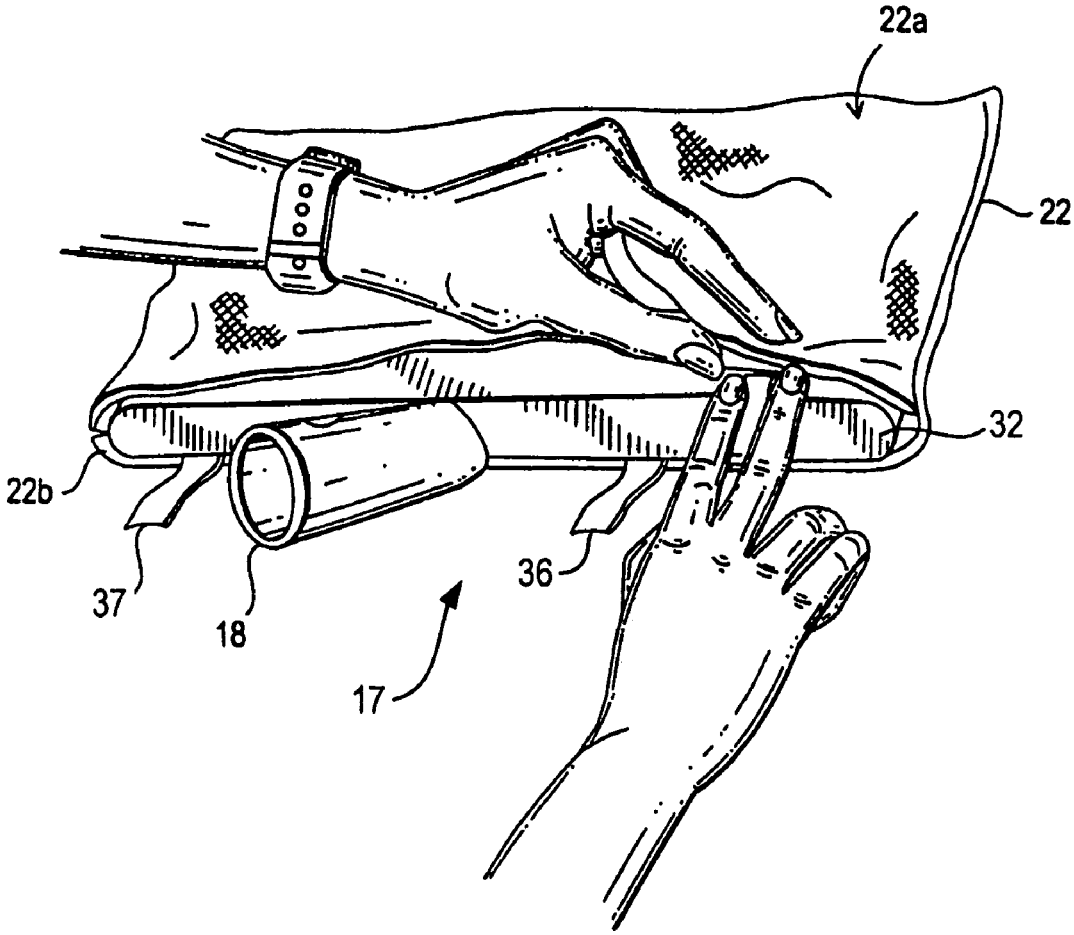
FIG. 4 is a perspective view of a steam pocket being attached to the steam pocket attachment constructed and arranged in accordance with the invention.

FIG. 2*a* is a perspective view of a rectangular frame 31 of fabric steam pocket attachment 17. Frame 31 has a back or proximal elongated base 32 with steam inlet 18 connected thereto. A pair of opposed a biased arms 33 and 34, each having an inwardly facing finger 33*a* and 34*a*, respectively, to the rectangular frame 31. Each arm 33 and 34 pivots inwardly by springs to allow steam pocket fabric 22 to be slipped onto frame 31. Referring now to FIG. 4, the construction of steam pocket 22 is shown in detail. In the illustrated embodiment, steam pocket 22 is a cloth or towel. It may be formed of any suitable fabric such as cotton or a synthetic fabric, such as polyester or polyolefin fiber. Preferably, the fabric of pocket 22 is a microfiber. Most preferably, the microfiber is a synthetic polyester microfiber.

Figure 2B:
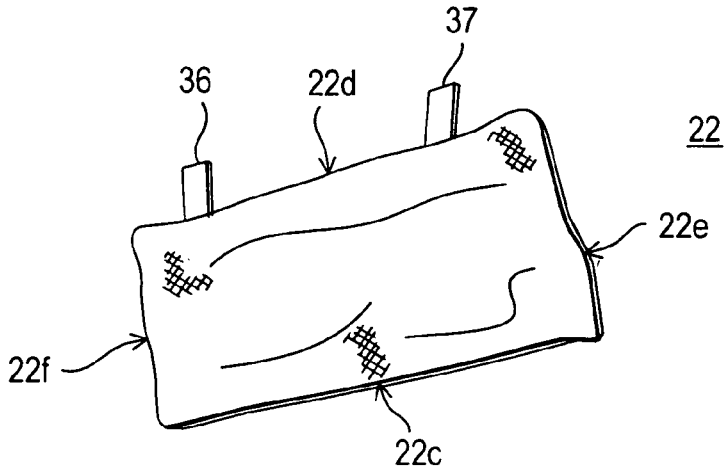
FIG. 2*b* is a perspective view of a steam pocket fabric cover for use with the steam pocket attachment of FIG. 2*a;*
Figure 2C:
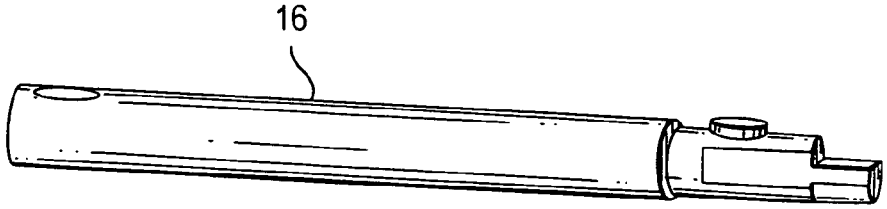
FIG. 2*c* is a perspective view of a rigid pipe suitable for us with the steam cleaner of FIG. 1.
Figure 3:
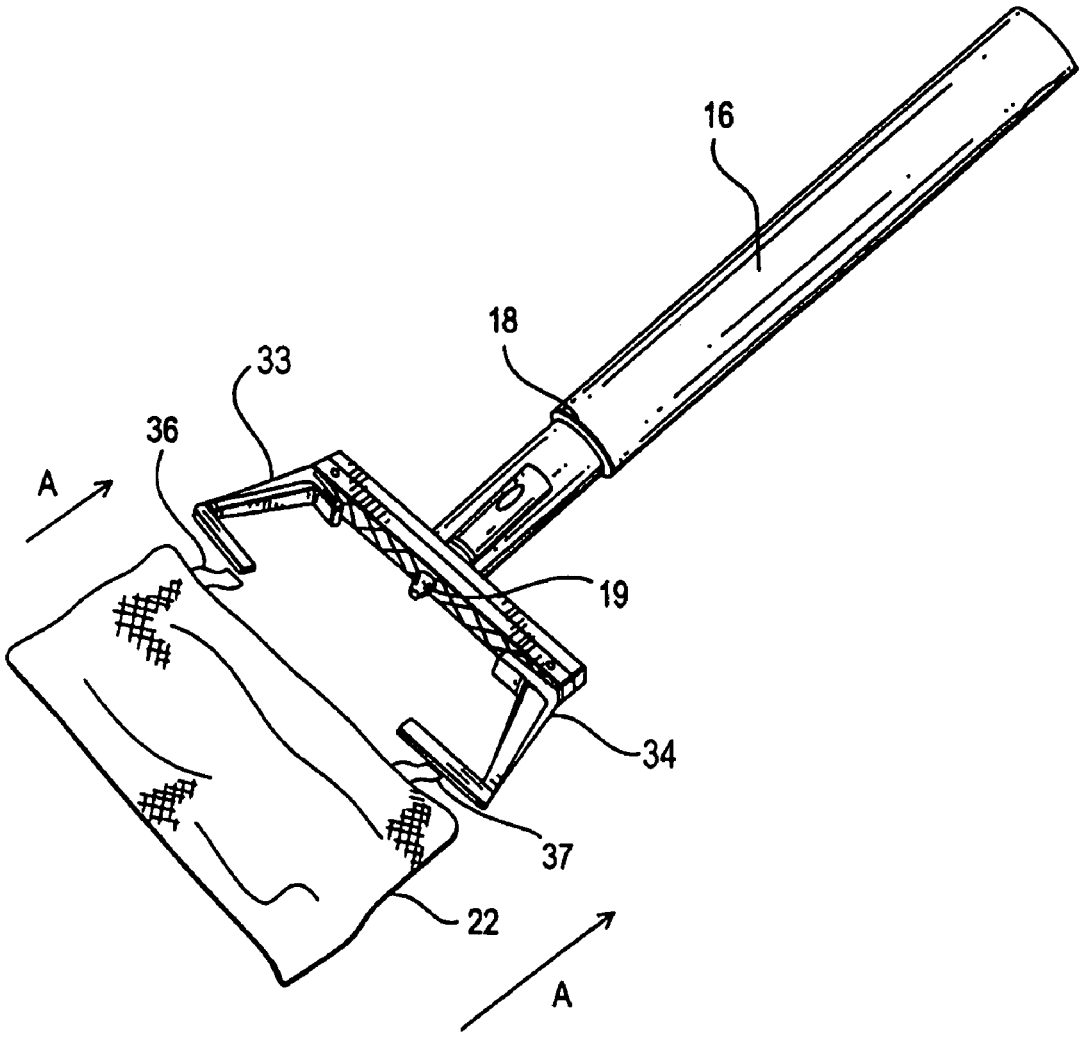
FIG. 3 is an exploded perspective view showing how a fabric steam pocket is mounted onto the attachment of FIG. 2*a;*

Steam pocket 22 is configured to slip over frame 31. In this respect, it is formed of a first layer 22*a* and an opposed second layer 22*b*, each having a rectangular shape with two opposed long edges 22*c* and 22*d* and two opposed short sides 22*e* and 22*f* as shown in FIG. 2*b*. Short edges 22*e* and 22*f* and one long side 22*c* are stitched to form pocket 22.

A pair of straps 36 and 37 are mounted on open side of the steam pocket 22. In the preferred embodiment, fasteners 36 and 37 are Velcro-type fasteners. Alternatively, straps 36 and 37 may include buttons or snaps. In each case, straps 36 and 37 are placed over base 32 and secured to hold pocket 22 in place when used to clean a floor or other surface.

Inlet coupling 18 attached to fabric steam pocket attachment 17 may be rotated so user 10 may use both sides of steam pocket fabric 22 without having to reinstall steam pocket 22. This extends the time steam pocket 22 may be used without having to rinse and reinstall it.

A fabric steam pocket attachment 17 with a steamed pocket fabric cover 22 in accordance with the invention provides a vast improvement over placing a towel onto a bristle attachment for a steam cleaner. It avoids puncture of the cloth by the bristles and provides twice the cleaning surface. Moreover, the fabric cover is easily installed and replaced.

It will thus be seen that the objects set forth above, among those made apparent from the preceding description, are efficiently attained and, since certain changes may be made in the above product without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

The present invention may be embodied in other specific forms without departing from the spirit or essential attributes of the invention. Accordingly, reference should be made to the appended claims, rather than the foregoing specification, as indicating the scope of the invention. A fabric steam pocket attachment with a fabric pocket cover in accordance with the invention provides a vast improvement over placing a towel onto a bristle attachment for a steam cleaned. It avoids puncture of the cloth by the bristles and provide twice the cleaning surface. Moreover, the fabric cover is easily installed and replaced.

What is claimed is:

1. An attachment for holding a fabric steam pocket, comprising:

a frame having an elongated back base having two ends with a steam inlet coupling positioned on one side of the elongated back base and a steam outlet mounted to the opposed side of the elongated back base;

a pair of side arms extending substantially perpendicular from the ends of the elongated back base on each side of the steam outlet and biased outwardly away from the steam outlet; and each arm having at the end thereof a substantially perpendicular inwardly facing finger rigidly attached to each arm extending towards each other and is parallel to the elongated back base, the arms adapted to hold a fabric steam pocket placed over the biased arms and fingers for providing a substantially planar fabric surface for steam cleaning; and wherein the steam outlet is configured and dimensioned to distribute steam substantially throughout the fabric steam pocket from the steam outlet mounted to the elongated back base of the frame after the fabric steam pocket is placed over the biased arms and fingers.

2. The steam attachment of claim 1, wherein the steam inlet is connected to the output of a steam cleaner and rotates.

3. The steam attachment of claim 1, wherein each arm is configured and dimensioned to pivot inwardly when the fabric steam pocket is positioned over the biased arms and fingers.

4. The steam attachment of claim 1, wherein each arm pivots inwardly via springs.

5. A steam pocket assembly for use with a steam cleaner, comprising:

a frame for holding a fabric steam pocket, the frame having an elongated back base having two ends with a steam inlet coupling positioned on a proximal side of the elongated back base between the ends and a steam outlet mounted to a distal side of the elongated back base between the ends;

a fabric steam pocket configured and dimensioned to be secured to the frame, the fabric steam pocket including: (i) a first substantially planar layer of fabric and a corresponding second layer of fabric with the first and second layer joined about a portion of the perimeter to provide an open side for mounting the frame, and (ii) at least two straps secured to the first layer along the open side and adjusted to wrap around the elongated back base of the frame and be secured to the second layer of fabric for securing the fabric steam pocket to the frame;

wherein the steam outlet is configured and dimensioned to distribute steam substantially throughout the fabric steam pocket from the steam outlet mounted to the distal side of the elongated back base of the frame after the fabric steam pocket is secured to the elongated back base of the frame.

6. The fabric steam pocket of claim 5, wherein the fabric is formed of a microfiber material.

7. The fabric steam pocket of claim 6, wherein the microfiber is polyester.

8. The fabric steam pocket of claim 5 wherein the straps are hook and loop fasteners.

9. The fabric steam pocket of claim 5 wherein the straps have snap fasteners.

10. The fabric steam pocket of claim 5 wherein the straps have button fasteners.

11. The steam pocket assembly of claim 5, whereas the frame includes a pair of side arms extending substantially perpendicular from the ends of the elongated back base on each side of the steam outlet.

12. The steam pocket assembly of claim 11, whereas the pair of side arms are each biased outwardly away from the steam outlet.

13. The steam pocket assembly of claim 12, wherein each arm has at the end thereof a substantially perpendicular inwardly facing finger rigidly attached to each arm extending towards each other and is parallel to the elongated back base, the arms adapted to hold the fabric steam pocket placed over the biased arms and fingers for providing a substantially planar fabric surface for steam cleaning.

14. The steam pocket assembly of claim 12, wherein each arm pivots inwardly via springs.

15. The steam pocket assembly of claim 11, wherein each arm is configured and dimensioned to pivot inwardly when the fabric steam pocket is positioned over the biased arms and fingers.

16. The steam pocket assembly of claim 5, wherein the first and second layers of fabric are substantially rectangular, with the first and second layer joined on two short sides and one long side of the rectangle to provide the open side to allow for securing on the frame.

* * * * *